US009543681B2

(12) United States Patent
Chen et al.

(10) Patent No.: US 9,543,681 B2
(45) Date of Patent: Jan. 10, 2017

(54) TERMINAL FOR AN ANTENNA CONNECTOR

(71) Applicant: Advanced-Connectek Inc., New Taipei (TW)

(72) Inventors: Ching-Tien Chen, New Taipei (TW); Shu-Lin Duan, New Taipei (TW); Wei Wan, New Taipei (TW); Xiao-Juan Qi, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/677,067

(22) Filed: Apr. 2, 2015

(65) Prior Publication Data

US 2015/0295330 A1 Oct. 15, 2015

(30) Foreign Application Priority Data

Apr. 9, 2014 (CN) ..... 2014 1 0139798

(51) Int. Cl.

| | |
|---|---|
| ***H01R 4/48*** | (2006.01) |
| ***H01R 13/26*** | (2006.01) |
| ***H01R 13/24*** | (2006.01) |
| *H01R 12/57* | (2011.01) |

(52) U.S. Cl.

CPC ..... *H01R 13/26* (2013.01); *H01R 13/2457* (2013.01); *H01R 12/57* (2013.01); *H01R 2201/02* (2013.01)

(58) Field of Classification Search

CPC . H01R 13/2442; H01R 13/24; H01R 13/2464; H01R 4/48

USPC ..... 439/66, 862, 500

See application file for complete search history.

(56) References Cited

U.S. PATENT DOCUMENTS

| | | | | |
|---|---|---|---|---|
| 6,695,628 | B2 * | 2/2004 | Yeh | H01R 13/2442 439/500 |
| 7,131,875 | B2 * | 11/2006 | Kodaira | H01R 13/2442 439/862 |
| 7,611,391 | B2 * | 11/2009 | Long | H01R 13/2442 439/500 |
| 8,070,498 | B2 * | 12/2011 | Shen | H01R 13/2492 439/66 |
| D660,249 | S * | 5/2012 | Chen | D13/154 |

(Continued)

FOREIGN PATENT DOCUMENTS

JP EP 2833481 A1 * 2/2015 ..... H01R 13/2442

*Primary Examiner* — Briggitte R Hammond

(74) *Attorney, Agent, or Firm* — Alan D. Kamrath; Kamrath IP Lawfirm, P.A.

(57) ABSTRACT

A terminal for an antenna connector has a soldering base, two wings, a resilient electric contacting arm, and two pre-pressing elements. The wings are formed on the soldering base, and each wing has an opening. The resilient electric contacting arm is formed on and protrudes from a rear end of the soldering base and has an extension section, a resilient section, and an electronic contacting section. The pre-pressing elements are located respectively in the openings of the wings, pre-press the resilient section of the resilient electric contacting arm toward the soldering base, and limit the resilient section to sway in an extent from an inner upper edge of each opening to the soldering base. The terminal with the pre-pressing elements performs an excellent electrical contacting effect to improve signal transmission of the antenna connector and a corresponding antenna module.

6 Claims, 12 Drawing Sheets

(56) References Cited

U.S. PATENT DOCUMENTS 8,298,021 B2 * 10/2012 Huang ..... H01R 13/2442
439/500

* cited by examiner

TERMINAL FOR AN ANTENNA CONNECTOR

BACKGROUND OF THE INVENTION

1. Field of the Invention

The present invention relates to a terminal and, more particularly, to a terminal for an antenna connector that is mounted in a portable electronic device and is able to be engaged with a corresponding connector of an antenna module. Furthermore, the terminal has a pre-pressing structure to improve electronic contact and conducting functions, avoid poor contacting problems, and provide stable signal transmission.

2. Description of Related Art

Portable electronic devices such as cell phones and tablets have 3rd-generation (3G) or Wireless Fidelity (Wi-Fi) wireless signal transmission modules. A conventional wireless transmission module has an antenna module mounted therein, so that the portable electronic device is able to implement wireless signal transmission through the antenna modules. The portable electronic device also has an antenna connector mounted securely therein to be engaged with a corresponding connector mounted securely in the antenna module.

A conventional antenna connector of a portable electronic device has a printed circuit board (PCB) and multiple terminals mounted securely on the PCB by surface mount technology (SMT). Each terminal has a soldering section and a resilient electric contacting arm. When the antenna module is installed in the portable electronic device and engaged with the antenna connector, the resilient electric contacting arms of the terminals respectively and tightly contact pad contacts on the antenna module.

However, the aforementioned terminal has no pre-pressing structure to force and tension the resilient electric contacting arm in a tension configuration. Therefore, the resilient electric contacting arm has a metal fatigue problem after repeated engagements and disengagements between the antenna connector and the antenna module. The fatigued resilient electric contacting arm contacts the pad contact loosely and has less contacting area with the pad contact, which makes signal transmission between the antenna module and the PCB of the electric device unstable or failed.

To overcome the shortcomings, the present invention provides a terminal for an antenna connector to mitigate or obviate the aforementioned problems.

SUMMARY OF THE INVENTION

The main objective of the invention is to provide a terminal for an antenna connector that is mounted in a portable electronic device and is able to be engaged with a corresponding connector of an antenna module. Furthermore, the terminal has a pre-pressing structure to improve electronic contact and conducting functions, avoid poor contacting problems, and provide stable signal transmission.

A terminal for an antenna connector in accordance with the present invention has a soldering base, two wings, a resilient electric contacting arm, and two pre-pressing elements. The wings are formed on the soldering base, and each wing has an annular opening. The resilient electric contacting arm is formed on and protrudes from a rear end of the soldering base and has an extension section, a resilient section, and an electronic contacting section. The pre-pressing elements are located respectively in the annular openings of the wings, pre-press the resilient section of the resilient electric contacting arm toward the soldering base, and limit the resilient section to sway in an extent from an inner upper edge of each annular opening to the soldering base. The terminal with the pre-pressing elements performs an excellent electrical contacting effect to improve signal transmission of the antenna connector and a corresponding antenna module.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
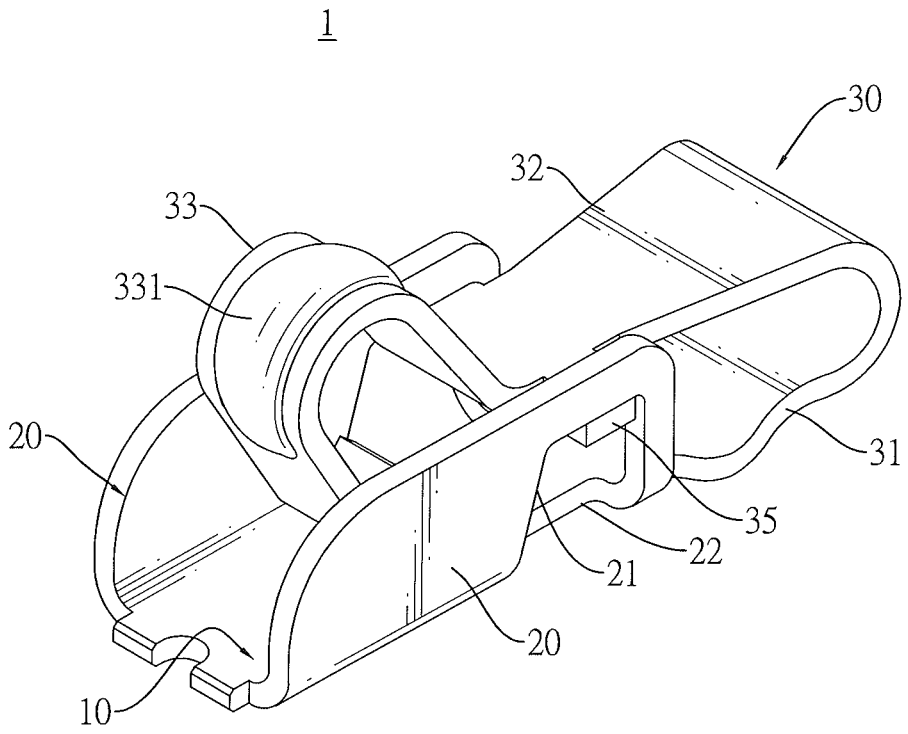
FIG. 1 is a perspective view of a first embodiment of a terminal for an antenna connector in accordance with the present invention.
Figure 2:
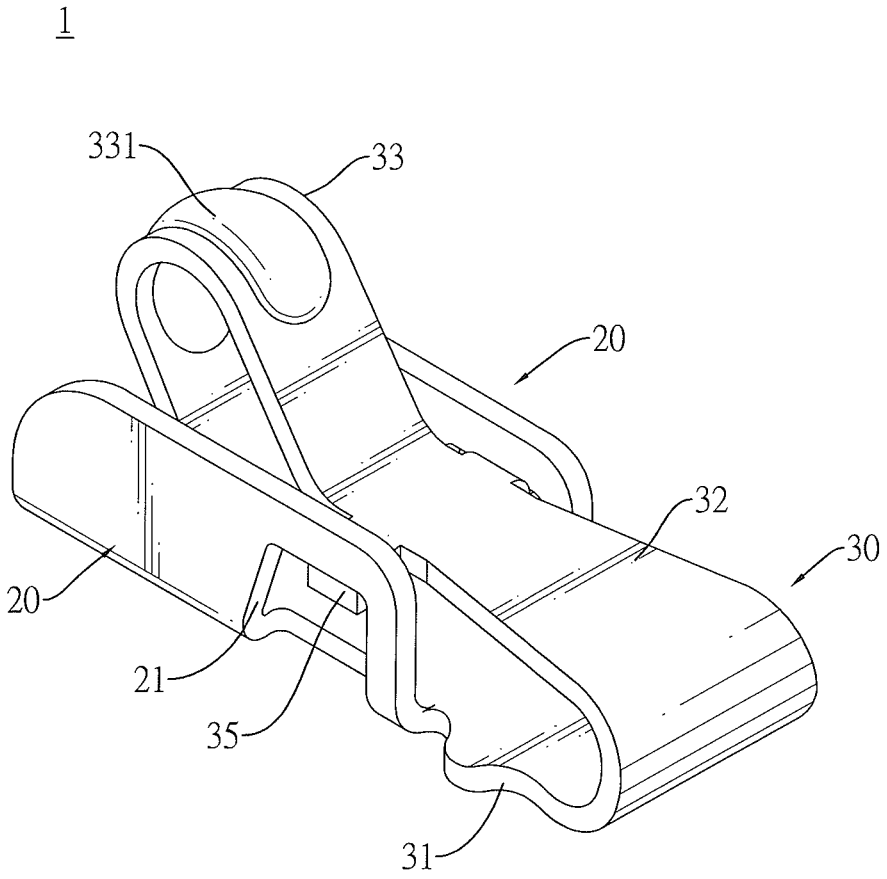
FIG. 2 is another perspective view of the terminal in FIG. 1.
Figure 3:
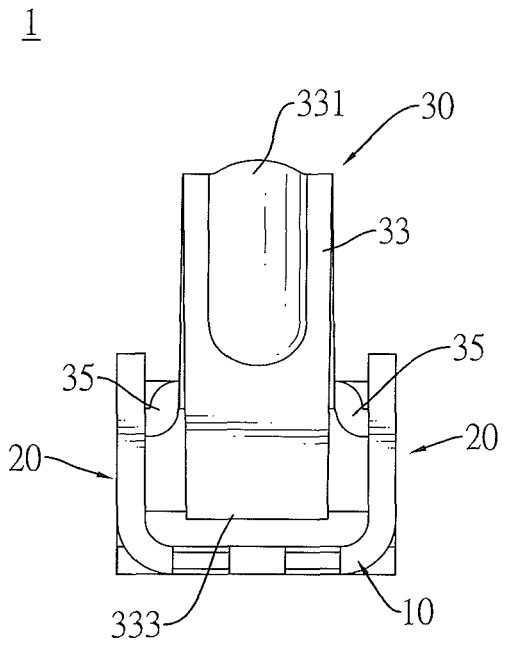
FIG. 3 is a front view of the terminal in FIG. 1.
Figure 4:
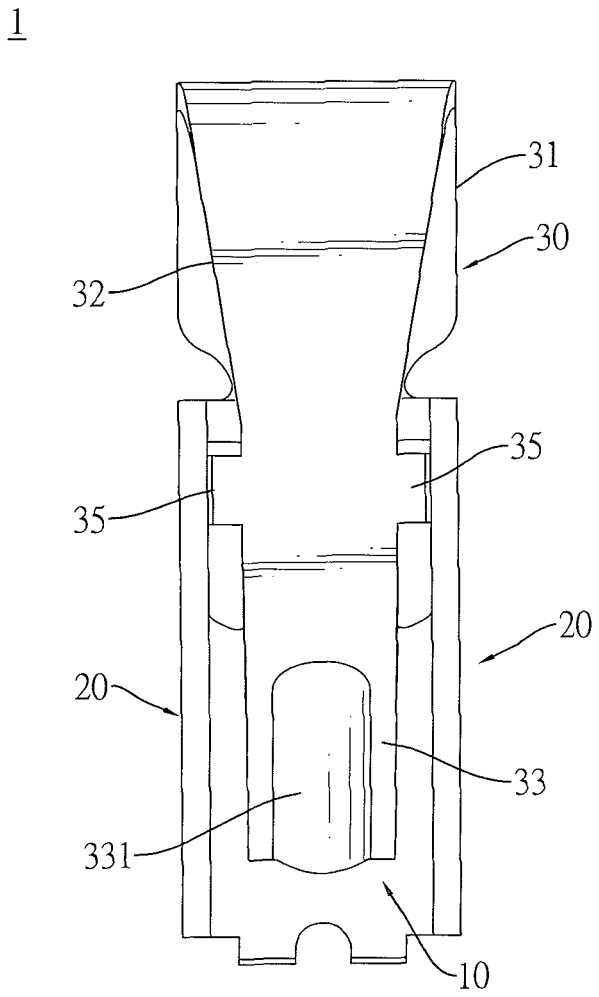
FIG. 4 is a top view of the terminal in FIG. 1.
Figure 5:
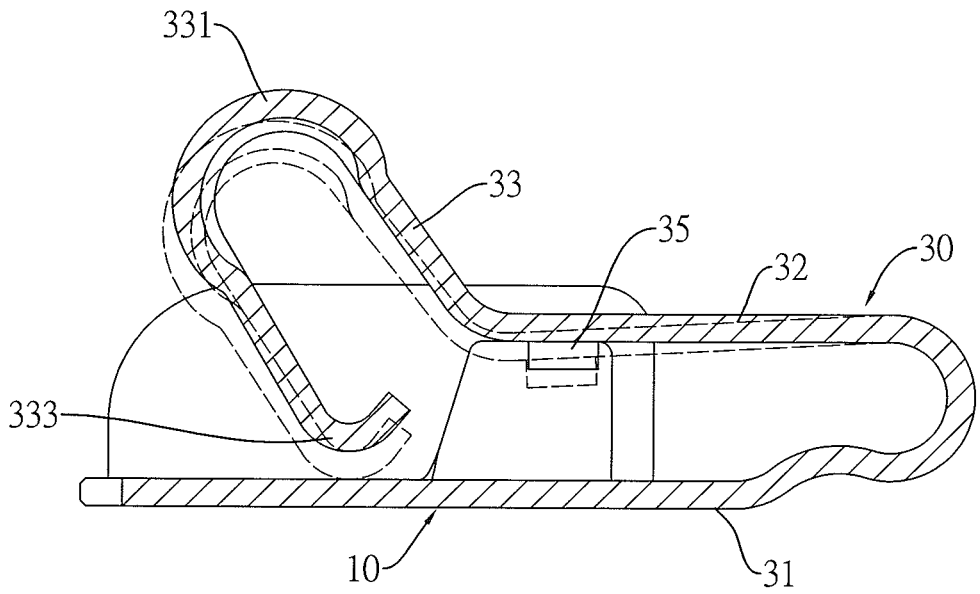
FIG. 5 is a cross sectional side view of the terminal in FIG. 1.
Figure 6:
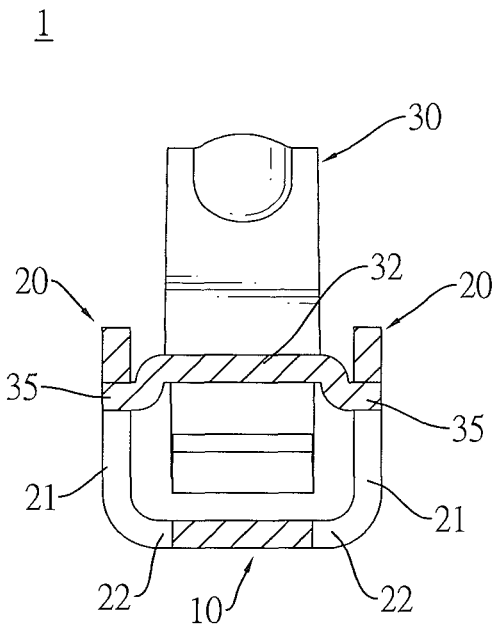
FIG. 6 is a cross sectional front view of the terminal in FIG. 1.
Figure 7:
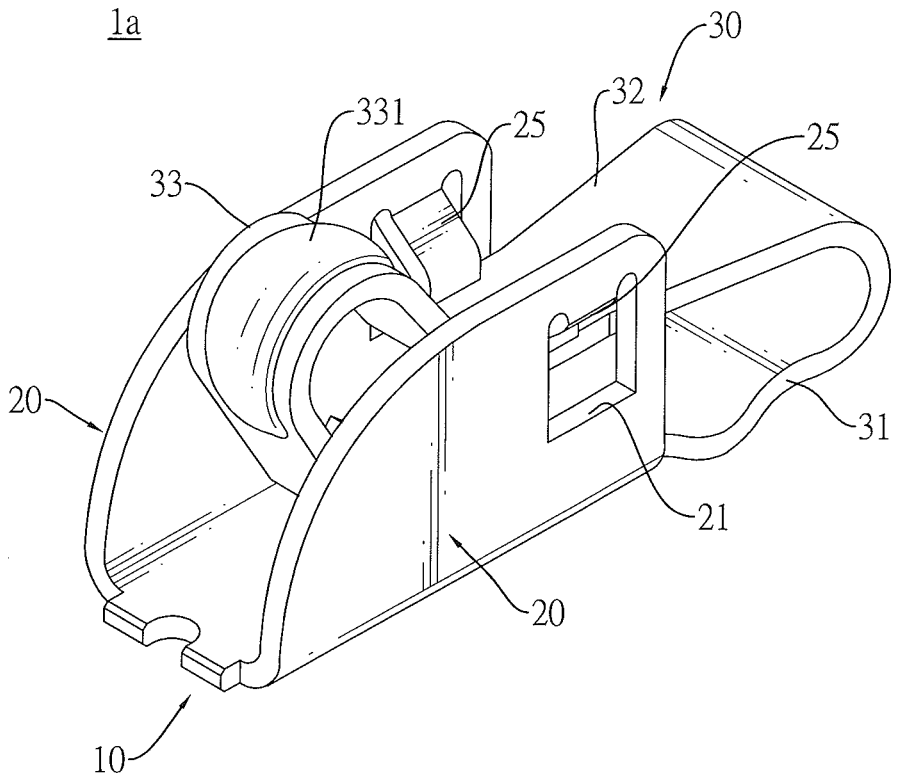
FIG. 7 is a perspective view of a second embodiment of a terminal for an antenna connector in accordance with the present invention.
Figure 8:
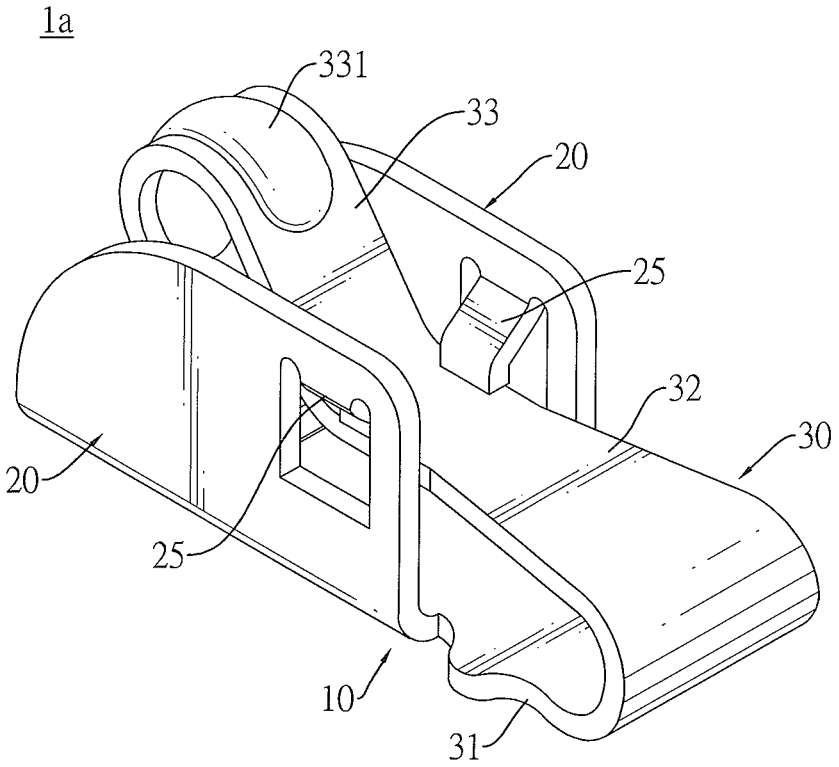
FIG. 8 is another perspective view of the terminal in FIG. 7.
Figure 9:
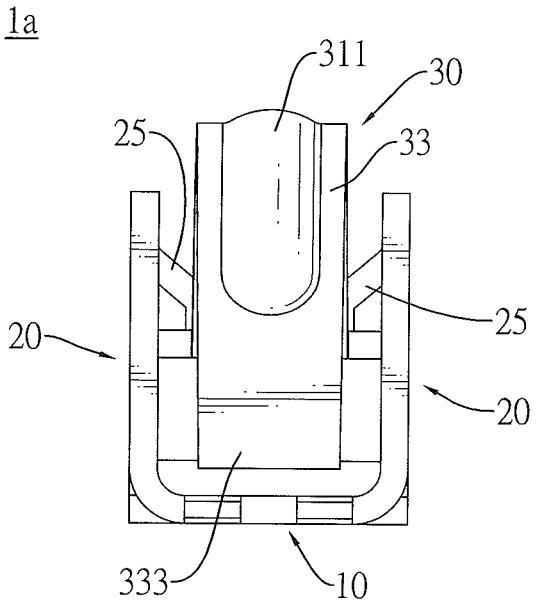
FIG. 9 is a front view of the terminal in FIG. 7.
Figure 10:
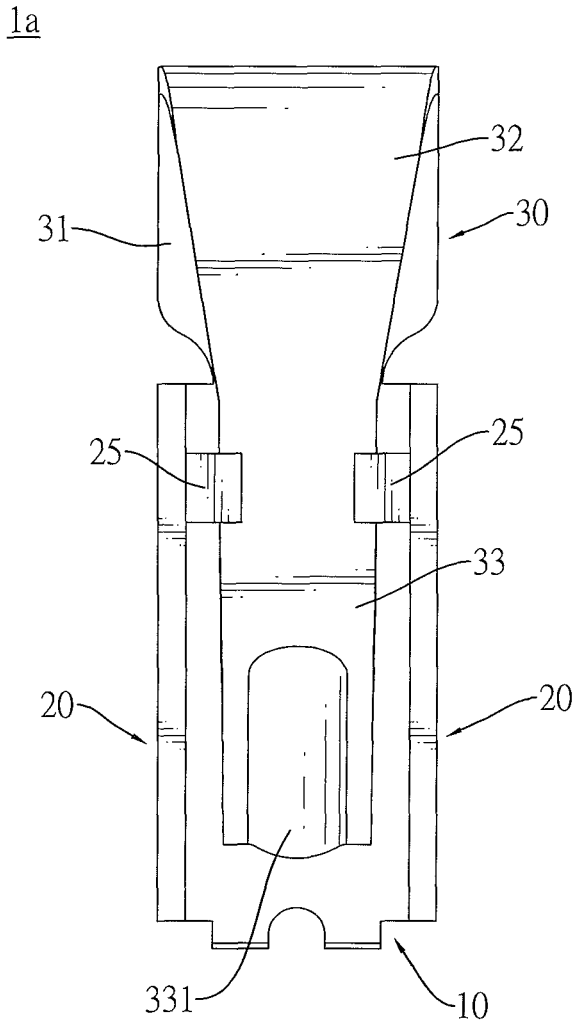
FIG. 10 is a top view of the terminal in FIG. 7.
Figure 11:
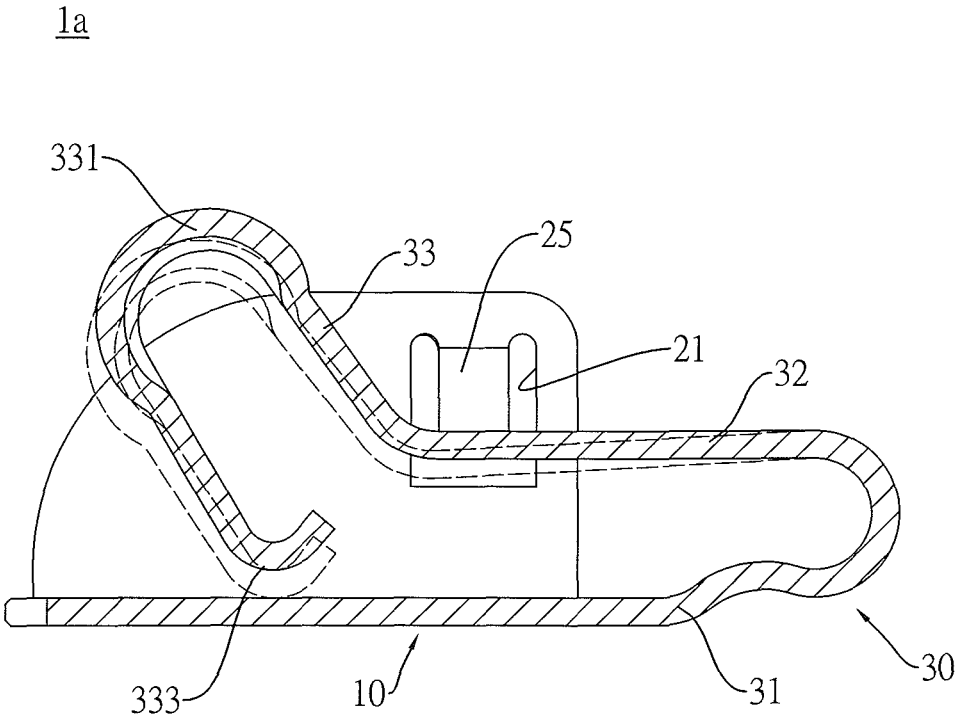
FIG. 11 is a cross sectional side view of the terminal in FIG. 7.
Figure 12:
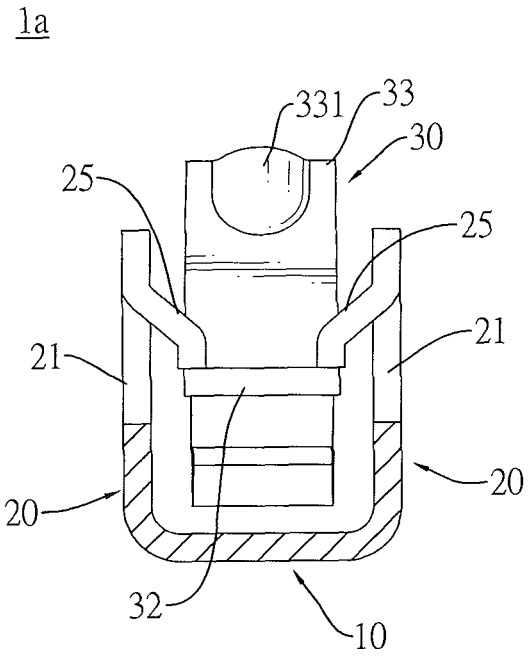
FIG. 12 is a cross sectional front view of the terminal in FIG. 7.

With reference to FIGS. 1 and 2, a first embodiment of a terminal 1 for an antenna connector in accordance with the present invention may be mounted in a portable electronic device and comprises a soldering base 10, two wings 20, a resilient electric contacting arm 30, and two pre-pressing elements 35.

The soldering base 10 is elongated.

With further reference to FIGS. 3 to 6, the wings 20 are formed on and protrude upward respectively from two opposite sides of the soldering base 10. Each wing 20 has an annular opening 21 and may further have a solder-receiving slot 22. The annular opening 21 is defined transversely through the wing 20. The solder-receiving slot 22 is defined through one of the opposite sides of the base 10 and communicates with the annular opening 21 of the wing 20. The solder-receiving slot 22 may receive sufficient solder and increases the soldering ability of the terminal 1 to a PCB during a soldering process.

The resilient electric contacting arm 30 is formed on and protrudes from a rear end of the soldering base 10 and has an extension section 31, a resilient section 32, and an electronic contacting section 33.

The extension section 31 is formed on and protrudes backward from the rear end of the soldering base 10.

The resilient section 32 is formed on and protrudes forward from a rear end of the extension section 32 and is capable of resiliently swaying relative to the soldering base 10.

The electronic contacting section 33 is reverse U-shaped, is formed on and protrudes from a front end of the resilient section 32, and has a hook-like pressing portion 333. The hook-like pressing portion 333 is V-shaped, is formed on a distal end of the electronic contacting section 33, and abuts the soldering base 10, so that the soldering base 10 applies a normal force to the hook-like pressing portion 333 and the resilient electric contacting arm 30. Therefore, the resilient electric contacting arm 30 is pre-pressed against and tensioned by the soldering base 10 and is able to firmly contact a corresponding pad contact or terminal of an external connector. Furthermore, the electronic contacting section 33 may have a convex portion 331 formed thereon and serves as a contacting element to improve the contacting function.

The pre-pressing elements 35 are located respectively in the annular openings 21 of the wings 20, pre-press the resilient section 32 of the resilient electric contacting arm 30 toward the soldering base 10, and limit the resilient section 32 to sway in an extent from an inner upper edge of each annular opening 21 to the soldering base 10. In the first embodiment, the pre-pressing elements 35 are formed on and protrude outward respectively from two opposite sides of the resilient section 32, extend respectively in the openings 21, and press respectively against the inner upper edges of the annular openings 21.

With reference to FIGS. 7 to 12, a second embodiment of the terminal 1*a* for an antenna connector in accordance with the present invention has a soldering base 10, two wings 20, a resilient electric contacting arm 30, and two pre-pressing elements 25. However, the pre-pressing elements 25 of the second embodiment are formed on and protrude respectively inward from the inner upper edges of the annular openings 21 and press against a top surface of the resilient section 32.

The terminal 1, 1*a* of the present invention has the following advantages.

1. The pre-pressing elements 35, 25 pre-press the resilient electric contacting arm 30, so that the resilient section 32 is resiliently deformed in a predetermined configuration and stores a sufficient resilient force. When a pad contact or a terminal on an antenna module is engaged with the terminal 1, 1*a* of the present invention, the resilient electric contacting arm 30 tightly contacts the pad contact or the terminal on the antenna connector with a sufficient and stable resilient force. The contacting area between the terminals or the terminal 1, 1*a* and the pad contact is increased, and impedance therebetween is reduced. Therefore, signal transmission between the portable electronic device and the antenna module is stably and efficiently implemented.

2. The V-shaped hook-like pressing portion 333 presses against the soldering base 10, so that the normal force from the soldering base 10 is applied to the resilient electric contacting arm 30 to increase the contacting strength between the resilient electric contacting arm 30 and the antenna module.

3. The convex portion 331 of the electronic contacting section 33 serves as a contacting element to improve contacting effect.

4. The solder-receiving slots 22 may receive sufficient solder and increases the soldering ability of the terminal 1 to a PCB during a soldering process.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A terminal for an antenna connector comprising:

a soldering base;

two wings formed on and protruding upward respectively from two opposite sides of the soldering base, with each wing having an annular opening defined transversely through the wing;

a resilient electric contacting arm formed on and protruding from a rear end of the soldering base and having:

an extension section formed on and protruding backward from the rear end of the soldering base;

a resilient section formed on and protruding forward from a rear end of the extension section and resiliently swaying relative to the soldering base; and an electronic contacting section being reverse U-shaped and formed on and protruding from a front end of the resilient section; and two pre-pressing elements respectively formed on and protruding inward from two inner upper edges of the annular openings of the wings, and pressing against a top surface of the resilient section of the resilient electric contacting arm toward the soldering base, and limiting the resilient section to sway in an extent from the inner upper edges of the annular openings to the soldering base.

2. The terminal for an antenna connector as claimed in claim 1, wherein the electronic contacting section has a hook-like pressing portion being V-shaped, formed on a distal end of the electronic contacting section, and abutting the soldering base when pressed toward the soldering base.

3. The terminal for an antenna connector as claimed in claim 1, wherein the electronic contacting section has a convex portion formed thereon.

4. A terminal for an antenna connector comprising:

a soldering base;

two wings formed on and protruding upward respectively from two opposite sides of the soldering base, with each wing having an annular opening defined transversely through the wing; and a resilient electric contacting arm formed on and protruding from a rear end of the soldering base and having an extension section formed on and protruding backward from the rear end of the soldering base;

a resilient section formed on and protruding forward from a rear end of the extension section and resiliently swaying relative to the soldering base;

an electronic contacting section being reverse U-shaped and formed on and protruding from a front end of the resilient section; and two pre-pressing elements formed on and protruding outward respectively from two opposite sides of the resilient section, extending respectively in the annular openings, and pressing respectively against the inner upper edges of the annular openings, located respectively in the annular openings of the wings, wherein each wing further has a solder-receiving slot which is defined through one of the opposite sides of the base and communicates with the annular opening of the wing.

5. The terminal for an antenna connector as claimed in claim 4, wherein the electronic contacting section has a hook-like pressing portion being V-shaped, formed on a distal end of the electronic contacting section, and abutting the soldering base when pressed toward the soldering base.

6. The terminal for an antenna connector as claimed in claim 4, wherein the electronic contacting section has a convex portion formed thereon.

* * * * *